US011970945B2

(12) United States Patent
Sun et al.

(10) Patent No.: US 11,970,945 B2
(45) Date of Patent: Apr. 30, 2024

(54) HOLE PROTECTION SYSTEM AND METHOD FOR COAL SEAM SLOTTING AND FRACTURING COMBINED DRAINAGE

(71) Applicants: Hancheng Zaozhuang Industrial Co., Ltd., Hancheng (CN); Chongqing University, Chongqing (CN)

(72) Inventors: Xiaoyan Sun, Hancheng (CN); Quanle Zou, Chongqing (CN); Qican Ran, Chongqing (CN); Peimiao Sang, Hancheng (CN); Jinyan Liang, Chongqing (CN); Ning Li, Hancheng (CN); Wei Pi, Hancheng (CN)

(73) Assignees: Hancheng Zaozhuang Industrial Co., Ltd., Hancheng (CN); Chongqing University, Chongqing (CN)

( * ) Notice: Subject to any disclaimer, the term of this patent is extended or adjusted under 35 U.S.C. 154(b) by 0 days.

(21) Appl. No.: 18/185,655

(22) Filed: Mar. 17, 2023

(65) Prior Publication Data

US 2023/0313682 A1 Oct. 5, 2023

(30) Foreign Application Priority Data

Mar. 28, 2022 (CN) ..... 202210314176.9

(51) Int. Cl.

| | |
|---|---|
| ***E21F 7/00*** | (2006.01) |
| ***E21B 7/18*** | (2006.01) |
| ***E21B 10/46*** | (2006.01) |
| ***E21B 33/138*** | (2006.01) |
| ***E21B 37/00*** | (2006.01) |
| ***E21B 43/10*** | (2006.01) |
| ***E21B 43/26*** | (2006.01) |
| ***E21C 41/18*** | (2006.01) |

(52) U.S. Cl.

CPC ..... *E21F 7/00* (2013.01); *E21B 7/18* (2013.01); *E21B 43/103* (2013.01); *E21B 43/2607* (2020.05); *E21C 41/18* (2013.01); *E21B 10/46* (2013.01); *E21B 33/138* (2013.01); *E21B 37/00* (2013.01)

(58) Field of Classification Search

CPC . E21B 7/18; E21B 43/26; E21B 7/061; E21B 23/001; E21B 41/0078; E21B 43/114; E21B 43/006; F16L 7/00

See application file for complete search history.

(56) References Cited

PUBLICATIONS

English translation for CN 109026070 (Year: 2018).*
English translation for CN 109357953 (Year: 2019).*
English translation for CN 111927456 (Year: 2020).*
English translation for CN 111305840 (Year: 2020).*

* cited by examiner

*Primary Examiner* — Zakiya W Bates
(74) *Attorney, Agent, or Firm* — Westbridge IP LLC

(57) ABSTRACT

A hole protection system and a method for coal seam slotting and fracturing combined drainage. The system includes a hydraulic slotting subsystem, a hydraulic fracturing subsystem and a flexible hole protection system. The hydraulic slotting subsystem includes an ultra-high pressure water jet generating module, a drill pipe drilling tool module, an orifice sealer, a gas slag separator and a drilling rig. The hydraulic fracturing system includes an emulsion pump station, a water tank, a hole sealing device, a fracturing string and a casing. The flexible hole protection system includes a front end fixing device, a water injection support pipe, a first flexible support and a water injection connecting section.

5 Claims, 7 Drawing Sheets

HOLE PROTECTION SYSTEM AND METHOD FOR COAL SEAM SLOTTING AND FRACTURING COMBINED DRAINAGE

CROSS-REFERENCE TO RELATED APPLICATIONS

This application claims priority to Chinese Patent Application No. 202210314176.9, filed on Mar. 28, 2022, the contents of which are hereby incorporated by reference.

TECHNICAL FIELD

The application relates to the field of coal mine gas prevention and control, and in particular to a hole protection system and a method for coal seam slotting and fracturing combined drainage.

BACKGROUND

Coal mining in China has been gradually extended to deep coal seams. Broken soft coal seams with a low permeability account for a large proportion in the coal seams. The broken soft coal seams are mainly characterized by broken coal bodies, a poor permeability, a high gas content and a high pressure, difficult drainage and a high treatment cost. At present, hydraulic pressure relief and permeability enhancement measures have become main means for coal mine disaster prevention and control. Common hydraulic measures include hydraulic slotting and hydraulic fracturing, etc. Hydraulic fracturing has a wide range of action and a good permeability enhancement effect. However, due to geological conditions of coal seam, crack propagation directions of hydraulic fracturing are difficult to control, and crack propagation in a fracturing area lacks pertinence. On the one hand, it is easy to form a high stress concentration area, and uneven fracturing is easy to cause a "blind area". On the other hand, a permeability enhancement effect in a long-distance gas-rich area is not obvious. Hydraulic slotting technology is accurate in slotting positioning, so a quick and effective slotting operation may be performed on local coal seams, and fixed-point accurate permeability enhancement in a gas-rich zone of the coal seams is achieved. However, the hydraulic slotting has a smaller influence range compared with the hydraulic fracturing. Complex and changeable broken soft coal seam conditions bring great difficulties to drilling. Due to a large deformation of a borehole, a borehole wall is easy to lose stability and collapse under an action of in-situ stress, gas pressure, structural stress and other factors. Moreover, a conventional hole protection method with a screen pipe has disadvantages of a small screen diameter and a high cost, so that an implementation of an existing prevention and control technology of borehole instability and collapse is not pertinent.

Therefore, considering characteristics of broken soft coal seams, it is urgent to develop a hole protection system and a method for coal seam slotting and fracturing combined drainage, so as to control coal and gas outburst coal seams

SUMMARY

An objective of the application is to provide a hole protection system and a method for coal seam slotting and fracturing combined drainage, so as to solve problems existing in the prior art.

A technical scheme adopted for realizing the objective of the application is as follows: a hole protection system for coal seam slotting and fracturing combined drainage, including a hydraulic slotting subsystem, a hydraulic fracturing subsystem and a flexible hole protection system.

The hydraulic slotting subsystem includes an ultra-high pressure water jet generating module, a drill pipe drilling tool module, an orifice sealer, a gas slag separator and a drilling rig.

The ultra-high pressure water jet generating module includes an emulsion pump station and a water tank. The drill pipe drilling tool module includes a drill pipe, a drill bit and a high-pressure water braid. The whole drill pipe is a hollow circular pipe. The drill bit is provided with a radial nozzle and an axial nozzle for injecting high-pressure water. The radial nozzle is arranged at a front end of the drill bit. The axial nozzle is arranged on a side wall of the drill bit. The drill bit is installed at a head end of the drill pipe. An inner cavity of the drill bit is communicated with an inner cavity of the drill pipe. An input end of the high-pressure water braid is connected with the emulsion pump station through a high-pressure pipeline, and an output end is connected with a tail end of the drill pipe.

The orifice sealer is a tubular body. A front end of the orifice sealer is open and fixed on a hole wall of a borehole orifice, and a rear end is connected with the gas slag separator. The drill pipe extends into a borehole from the rear end of the orifice sealer. The gas slag separator is connected with a gas extraction pipeline.

The hydraulic fracturing system includes an emulsion pump station, a water tank, a hole sealing device, a fracturing string and a casing. The water tank and the emulsion pump are connected by the high-pressure hose. After the high-pressure water is generated, the high-pressure water enters a water quantity regulating device through a high-pressure water pipe. The high-pressure water pipe is provided with a flowmeter and the pressure gauge. A front section of the fracturing string is connected with a high-pressure pipeline adapter.

The flexible hole protection system includes a front end fixing device, a water injection support pipe and a first flexible support. A pipe wall of the water injection support pipe is provided with a water injection hole. A head end of the water injection support pipe is connected and fixed with the front end fixing device, and a tail end is communicated with a hydraulic pump. The front end fixing device is provided with a supporting hook claw. The supporting hook claw adopts a compression spring structure. The water injection support pipe is arranged in the inner cavity of the drill pipe. The front end fixing device is arranged in a central hole channel of the drill bit. The supporting hook claw of the front end fixing device is clamped with an inner wall of the central hole channel.

The first flexible support is a net sleeve structure. The first flexible support includes a plurality of annular support pipes arranged in sequence along a longitudinal direction. Each annular support pipe includes several unit waves, and the unit waves are arranged in sequence along a circumferential direction. Two adjacent annular support pipes are distributed in mirror symmetry. Two opposite wave peaks of the two adjacent annular support pipes are fixedly connected. Inner cavities of the two adjacent annular support pipes are communicated. The inner cavities of the plurality of annular support pipes form a pipe net structure.

The first flexible support in a contracted state is sleeved on a pipe body of the water injection support pipe under a non-working condition. The water injection hole is communicated with a pipe net inner cavity of the first flexible support.

A technical effect of the application is little doubt.

Firstly, different permeability enhancement modes may be applied with a flexible hole protection device according to occurrence positions of gas-rich zones, so a gas drainage effect is excellent.

Secondly, the flexible hole protection system may actively adapt to a shape of a slot in the hydraulic slotting, so a way of actively maintaining the slot is realized, a safety of a working face may be better guaranteed; and the bracket may be recovered and reused many times after the hole protection, saving a lot of cost.

Thirdly, the system may be widely applied to broken soft coal seams under complex geological conditions, and may support a fracturing borehole and a slotted slot, so a gas drainage efficiency is further improved.

Fourthly, a stability of the borehole and the slot may be ensured by a flexible support device. Compared with passive hole protection with conventional screen pipes, the first flexible support has a wider hole protection range, so flexible hole protection may realize active hole protection when deformation is small at an initial stage of drilling instability, maintain a more complete ring structure of the borehole, reduce a supporting force required for the hole protection, achieve efficient and uniform permeability enhancement of coal seams with a complex geological structure, improve the gas drainage efficiency of the coal seams with the complex geological structure, and thus achieve a purpose of effective prevention and control of gas disasters in the coal seams with the complex geological structure.

DETAILED DESCRIPTION OF THE EMBODIMENTS

Figure 1:
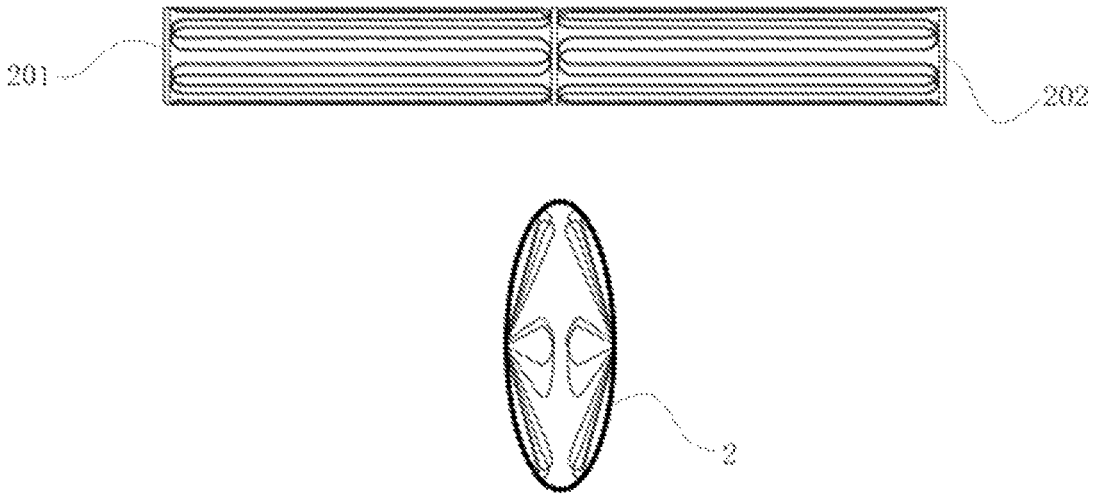
FIG. 1 is a schematic diagram of an integrated drilling, slotting and protection system.

The application is further described in combination with embodiments. However, it should not be understood that a scope of an above subject matter of the application is limited to following embodiments. Without departing from an above technical idea of the application, various substitutions and changes made according to common technical knowledge and customary means in this field should be included in a protection scope of the application.

Embodiment 1

This embodiment provides a hole protection system for coal seam slotting and fracturing combined drainage, including a hydraulic slotting subsystem, a hydraulic fracturing subsystem and a flexible hole protection system.

The hydraulic slotting subsystem includes an ultra-high pressure water jet generating module, a drill pipe drilling tool module, an orifice sealer, a gas slag separator and a drilling rig. The ultra-high pressure water jet generating module includes an emulsion pump station and a water tank. The drill pipe drilling tool module includes a drill pipe, a drill bit and a high-pressure water braid. The whole drill pipe is a hollow circular pipe. The drill bit is provided with a radial nozzle and an axial nozzle for injecting high-pressure water. The radial nozzle is arranged at a front end of the drill bit. The axial nozzle is arranged on a side wall of the drill bit. The drill bit is installed at a head end of the drill pipe. An inner cavity of the drill bit is communicated with an inner cavity of the drill pipe. An input end of the high-pressure water braid is connected with the emulsion pump station through a high-pressure pipeline, and an output end is connected with a tail end of the drill pipe. The orifice sealer is a tubular body. A front end of the orifice sealer is open and fixed on a hole wall of a borehole orifice, and a rear end is connected with the gas slag separator. The drill pipe extends into a borehole from the rear end of the orifice sealer. The gas slag separator is connected with a gas extraction pipeline. The water tank and the emulsion pump in the hydraulic slotting subsystem are connected by a high-pressure hose. A pressure control device mainly adjusts and controls a water pressure through a stop valve, and the pressure is displayed by a pressure gauge. The input end of the high-pressure water braid is connected with the emulsion pump through the high-pressure hose, and the output end is connected with a special sealed drill pipe arranged on the drilling rig. Drill pipe joints are connected by drill pipe connectors. A front section of the drill pipe is nested with a drilling-slotting integrated drill bit, and a water outlet hole with a diameter of 5 mm is designed on the drill bit.

The hydraulic fracturing system includes an emulsion pump station, a water tank, a hole sealing device, a fracturing string and a casing. The water tank and the emulsion pump are connected by the high-pressure hose. After the high-pressure water is generated, the high-pressure water enters a water quantity regulating device through a high-pressure water pipe. The high-pressure water pipe is provided with a flowmeter and the pressure gauge. A front section of the fracturing string is connected with a high-pressure pipeline adapter. The water tank and the emulsion pump are connected by the high-pressure hose in a high-pressure water generating device of the hydraulic fracturing subsystem. The pressure is mainly controlled by adjusting and controlling the water pressure through the stop valve, and the pressure is displayed by the pressure gauge. After the high-pressure water is generated, the high-pressure water enters the water quantity regulating device through the high-pressure water pipe. In this part, the high-pressure water pipe is connected with the flowmeter with a flowmeter connecting valve through a flowmeter connector, and the high-pressure water pipe is also connected with the pressure gauge with a pressure gauge connecting valve through a pressure gauge connector. A plugging device mainly consists of a grouting pipe, a first packer, a second packer, a one-way valve, the fracturing string, the high-pressure pipeline adapter and a water outlet screen pipe. The front section of the fracturing string is connected with the high-pressure pipeline adapter, and the second packer and the first packer are sequentially connected.

The flexible hole protection system includes a front end fixing device, a water injection support pipe and a first flexible support. A pipe wall of the water injection support pipe is provided with a water injection hole. A head end of the water injection support pipe is connected and fixed with the front end fixing device, and a tail end is communicated with a hydraulic pump. The front end fixing device is provided with a supporting hook claw. The supporting hook claw adopts a compression spring structure. The water injection support pipe is arranged in the inner cavity of the drill pipe. The front end fixing device is arranged in a central hole channel of the drill bit. The supporting hook claw of the front end fixing device is clamped with an inner wall of the central hole channel.

Figure 2:
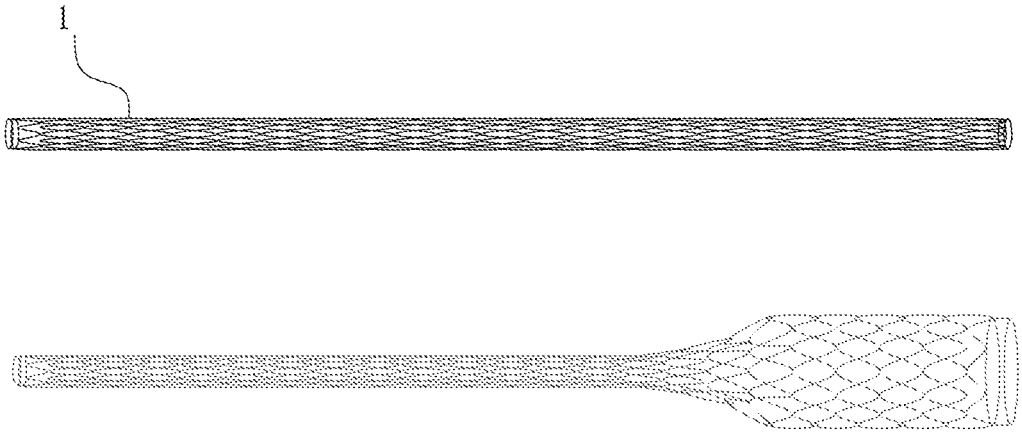
FIG. 2 is a contraction and an expansion diagram of a flexible bracket.

The flexible support around the borehole is shown in FIG. 2, and the first flexible support is a net sleeve structure. The first flexible support includes a plurality of annular support pipes arranged in sequence along a longitudinal direction. Each annular support pipe includes several unit waves, and the unit waves are arranged in sequence along a circumferential direction. Two adjacent annular support pipes are distributed in mirror symmetry. Two opposite wave peaks of the two adjacent annular support pipes are fixedly connected. Inner cavities of the two adjacent annular support pipes are communicated. The inner cavities of the plurality of annular support pipes form a pipe net structure.

The first flexible support in a contracted state is sleeved on a pipe body of the water injection support pipe under a non-working condition. The water injection hole is communicated with a pipe net inner cavity of the first flexible support.

Embodiment 2

A main structure in this embodiment is the same as that in embodiment 1. A second flexible support 2 is a flexible support fitting around a slot. As shown in FIG. 1, the second flexible support 2 includes a circular pipe I 201 and a circular pipe II 202, and a plurality of annular support pipes arranged between the circular pipe I 201 and the circular pipe II 202. Each annular support pipe includes a plurality of unit waves, and the unit waves are arranged in sequence along the circumferential direction. Two opposite wave peaks of two adjacent annular support pipes are fixedly connected. An inner cavity of the second flexible support 2 is communicated with a hydraulic pump. When working, fixed tractors drive the circular pipe I 201 and the circular pipe II 202 to approach, and the annular support pipes deform and fit the slot.

The fixed tractors are mainly composed of a drainage valve body and an electromagnetic mechanism, and are mainly triggered by an electrode of the valve, so as to indirectly drive an electromagnet to loosen and complete a mechanical movement. Traction slide rail devices are mainly distributed on an outer wall of the water injection support pipe and consist of transverse grooves. When working, the tractors at both ends are triggered to generate contraction forces from both sides to an inside at the same time. Together with the movement of the traction slides, the second flexible support may be driven to move and expand to the slot.

The first flexible support and the second flexible support 2 are made of silicon bronze elastic alloy (Qsi1-3), and the nickel-containing silicon bronze has high elastic properties and may be used for manufacturing various springs working in a corrosive media (such as well water and groundwater).

Embodiment 3

Figure 3:
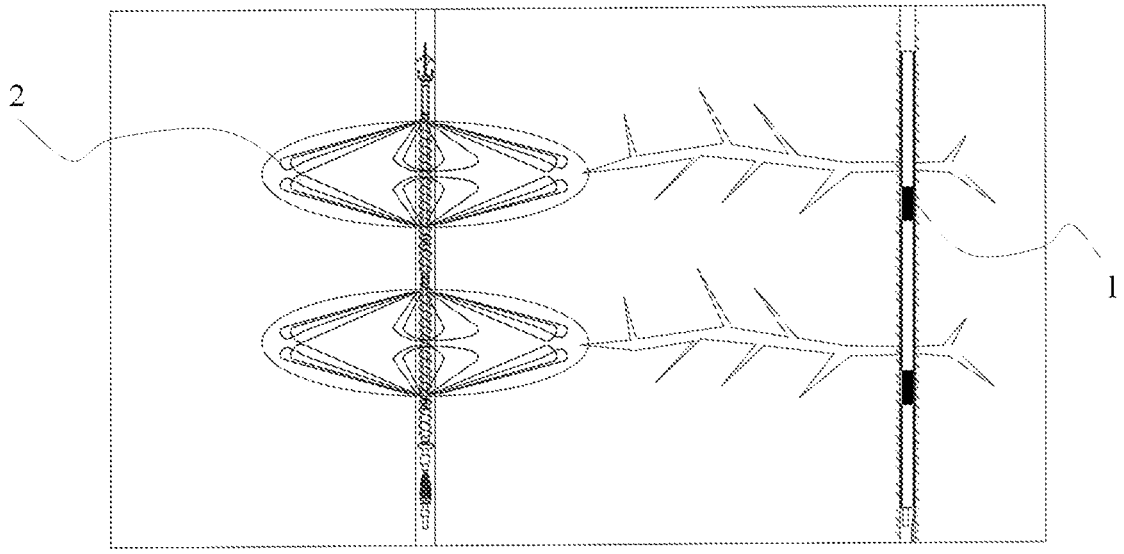
FIG. 3 is a schematic diagram of slotting and fracturing combined hole protection with a double-hole flexible system.
Figure 6:
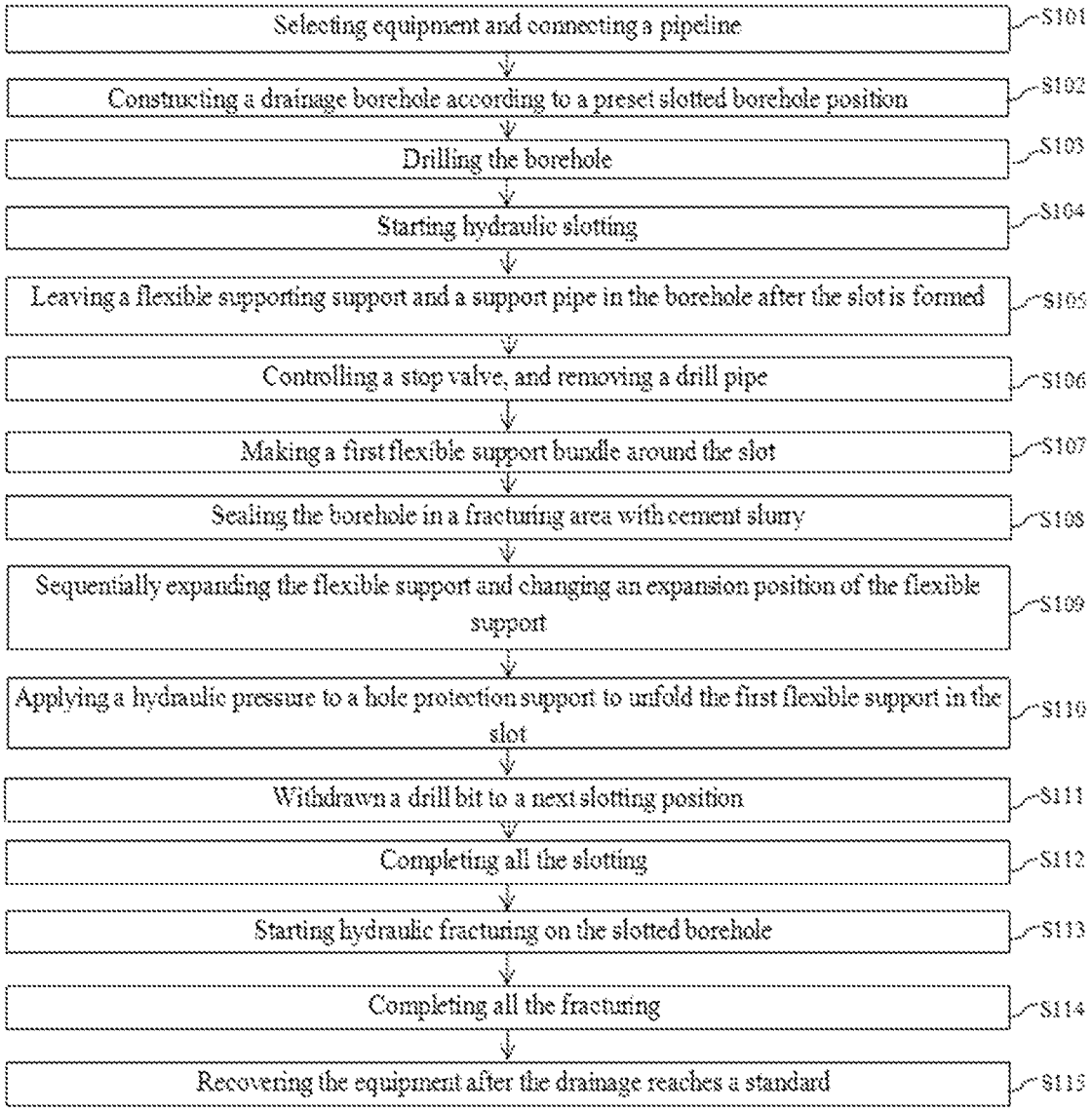
FIG. 6 is a flow chart of an in-situ slotting-fracturing combined permeability enhancement and hole protection method.

The main structure in this embodiment is the same as that in embodiment 2. According to an occurrence position of a gas-rich zone, the gas-rich zone in this embodiment is distributed around the borehole and is close to the borehole, so an in-situ slotting-fracturing combined permeability enhancement mode may be applied. The borehole is first arranged for the slotting, and then a fracturing operation is further carried out on a basis of the slotting borehole to strengthen a permeability enhancement effect of long-distance extraction of the slotting borehole. With reference to FIG. 3, the in-situ slotting-fracturing combined permeability enhancement mode specifically includes following steps as shown in FIG. 6:

- S101, installing and supporting firmly the drilling rig, the pump, the tank and the connecting pipeline, etc. after these equipment are transported to a construction site; connecting the pipeline, the emulsion pump, laying the high-pressure pipeline and debugging the high-pressure pipeline; completing an inspection of related systems after a preparation for equipment installation and connection is completed;
- S102, constructing a drainage borehole according to an outburst prevention design of a working face and according to a preset slotting borehole position;
- S103, sequentially connecting a diamond compact drill bit and a hydraulic slotting shallow spiral drill pipe, and installing a hydraulic slotting spray head with a nozzle at a front end of a high-pressure water jet drill pipe; pushing the drill bit to connect the drill pipe with the drill bit, pushing the drilling rig, starting the drilling rig to make the drill pipe rotate at a low speed, and drilling the borehole by using low-pressure water;
- S104, turning on a high-pressure water pump to make water enter the drill pipe through an ultra-high pressure hose after the drill bit is drilled to a designed position; controlling the stop valve, adjusting the pressure at a drilling rig end, and adjusting a pressure valve to gradually increase the pressure of a jet system; and carrying out rotary cutting on a coal body of a borehole wall by using a high-pressure water jet from a high-pressure spray head after the pressure is stable, where a rotary cutting duration for each cutter is 20-25 minutes;
- S105, withdrawing with the drill bit and the drill pipe after the slot is formed, opening the front end fixing device of the support, and leaving a flexible support and the support pipe in the borehole;
- S106, controlling the stop valve, letting the water return to the water tank through the high-pressure water pipe, and removing the drill pipe at this position;
- S107, disassembling the withdrawn drill pipe after the drill pipe is withdrawn, connecting the water injection support pipe with the hydraulic pump, and applying a hydraulic pressure to a hole protection support; turning on the tractors, triggering the tractors at the slot, and making the first flexible support bundle around the slot through the movement of the slide rails;
- S108, adjusting the pressure of the drilling rig end, and drilling from the borehole position of a hydraulic slotting borehole to a preset position with the drilling rig; withdrawing the drill pipe and the drill bit, and meanwhile sealing the borehole in a fracturing area with cement slurry, and leaving the flexible support and the support pipe in the borehole;
- S109, adjusting an expansion device of a one-way valve, adjusting the one-way valve according to a fracturing borehole position, and sequentially expanding the flexible support and changing an expansion position of the flexible support;

S110, connecting the water injection support pipe to the hydraulic pump after the drill pipe is withdrawn, and applying the hydraulic pressure to the hole protection support to unfold the first flexible support in the slot for fitting around the slot;

S111, controlling the stop valve to make water enter the borehole through the high-pressure water pipe and the drill pipe when the drill bit is withdrawn to a next slotting position, and first delivering water to the borehole for a period of time to remove residues in the borehole, and then slotting after return water from the borehole is normal;

S112, immediately stopping the pressure and turning off the water pump after all the slotting is completed, closing a pressure relief valve, dismantling a hydraulic slotting shallow spiral integral drill pipe and piling dismantled drill pipes neatly, and keeping a high-low pressure conversion slotting device, the diamond compact drill bit and an ultra-high pressure rotary water tail properly;

S113, connecting the high-pressure pipeline adapter to a hydraulic fracturing pump group with the fracturing string to start the hydraulic fracturing pump group, opening the water tank to make the high-pressure water reach a fracturing channel through the high-pressure pipeline, and starting hydraulic fracturing on the slotting borehole;

S114, immediately stopping the pressure and turning off the water pump after the all the fracturing is completed, connecting pipes for the gas drainage, and recording a gas drainage concentration and a purity in time; and S115, opening the one-way valve from an outlet section after the drainage reaches a standard, and starting to relieve the pressure step by step according to the positions of the fracturing borehole and the slot, and recovering the water injection support pipe and the contracted first flexible support.

Embodiment 4

Figure 4:
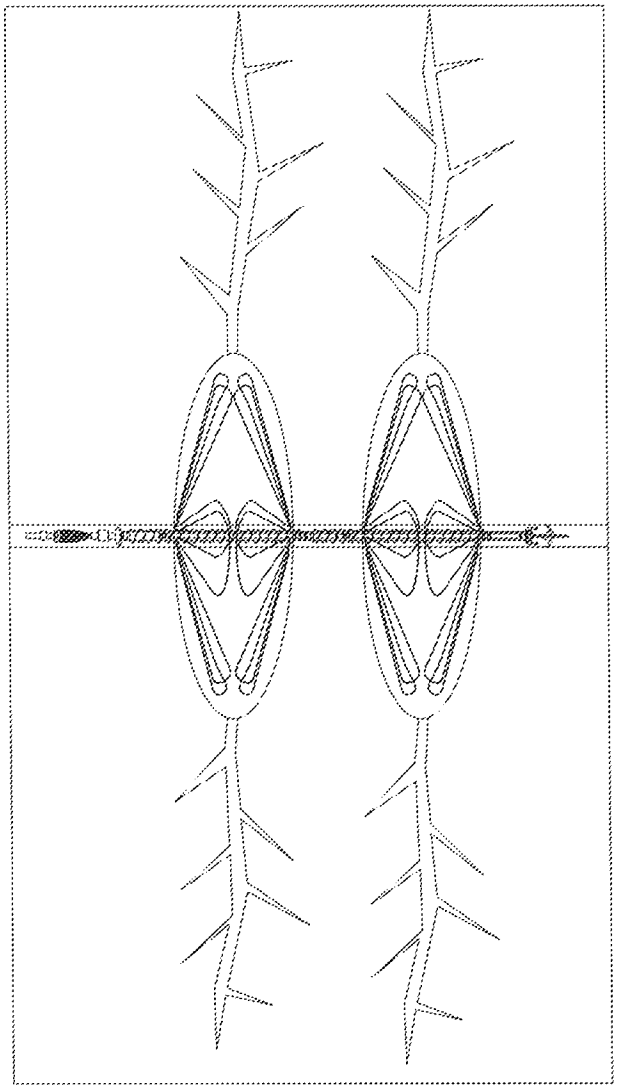
FIG. 4 is a schematic diagram of slotting and fracturing combined hole protection with a single-hole flexible system.
Figure 5:
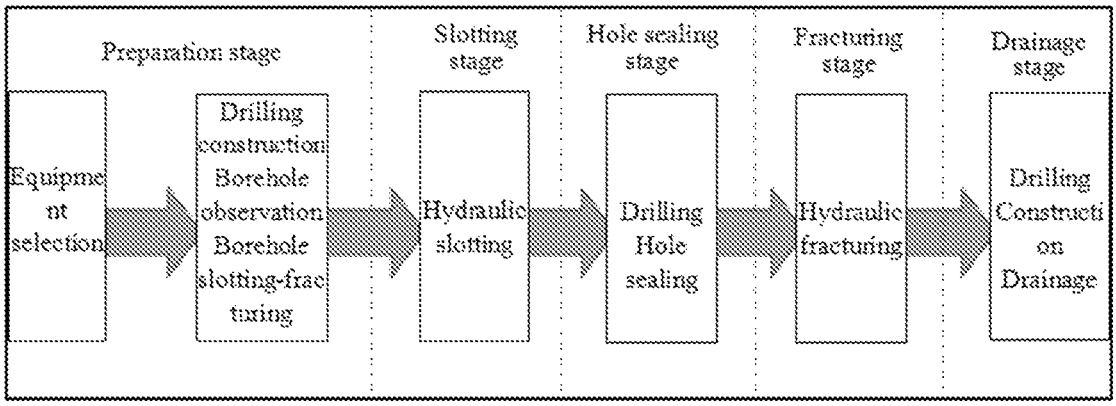
FIG. 5 is a construction flow chart of slotting and fracturing combined hole protection.
Figure 7:
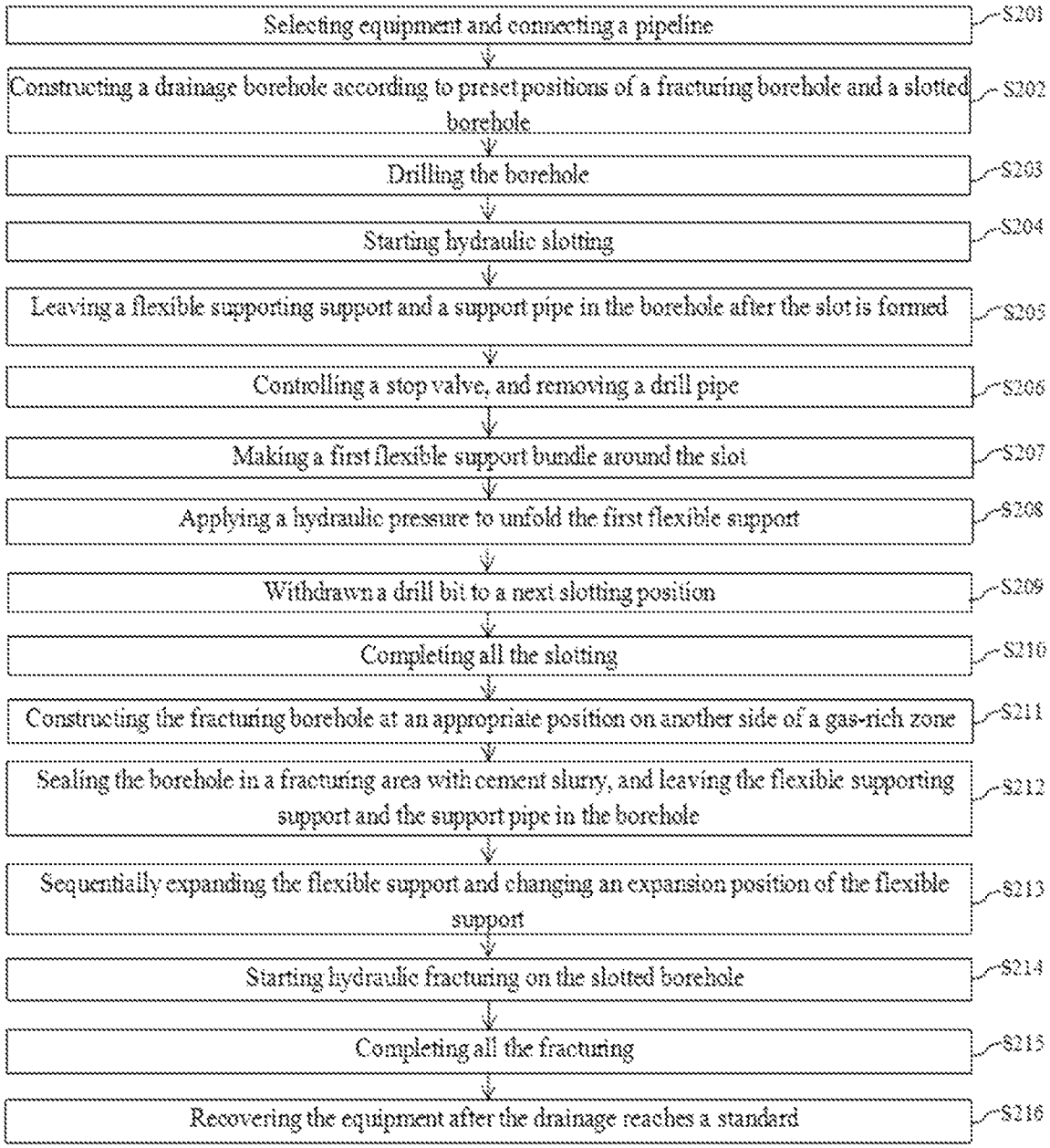
FIG. 7 is a flow chart of a dividing drilling slotting-fracturing combined permeability enhancement and hole protection method.

The main structure in this embodiment is the same as that in embodiment 1. According to the occurrence position of the gas-rich zone, the gas-rich zone in this embodiment is distributed on one side of the borehole and is far away from the borehole. When the permeability enhancement effect of a single slotting process is insufficient, a dividing drilling slotting-fracturing combined permeability enhancement mode is adopted. The slotting borehole is arranged on one side of the gas-rich zone, and the fracturing borehole is constructed on another side. The slotting weakens the coal body, guiding fractured cracks develop directionally towards the gas-rich zone. A flexible hole protection-groove protection system is designed to deal with a problem that the slotted slot is unstable and the fracturing borehole is easy to collapse, so as to protect the slot formed by hydraulic measures and the drainage borehole and ensure a smooth gas drainage after permeability enhancement. With reference to FIG. 4 and FIG. 5, the dividing drilling slotting-fracturing combined permeability enhancement mode includes following steps as shown in FIG. 7:

S201, installing and supporting firmly the drilling rig, the pump, the tank and the connecting pipeline, etc. after these equipment are transported to the construction site; connecting the pipeline, the emulsion pump, laying the high-pressure pipeline and debugging the high-pressure pipeline; completing the inspection of the related systems after the preparation for the equipment installation and connection is completed;

S202, constructing the drainage borehole according to the outburst prevention design of the working face and according to a preset fracturing borehole position and the preset slotting borehole position;

S203, sequentially connecting the diamond compact drill bit and the hydraulic slotting shallow spiral drill pipe, and installing the hydraulic slotting spray head with the nozzle at the front end of the high-pressure water jet drill pipe; pushing the drill bit to connect the drill pipe with the drill bit, pushing the drilling rig, starting the drilling rig to make the drill pipe rotate at a low speed, and drilling the borehole by using the low-pressure water;

S204, turning on the high-pressure water pump to make the water enter the drill pipe through the ultra-high pressure hose after the drill bit is drilled to the designed position; controlling the stop valve, adjusting the pressure at the drilling rig end, and adjusting the pressure valve to gradually increase the pressure of the jet system; and carrying out the rotary cutting on the coal body of the borehole wall by using the high-pressure water jet from the high-pressure spray head after the pressure is stable, where the rotary cutting duration for each cutter is 20-25 minutes;

S205, withdrawing with the drill bit and the drill pipe after the slot is formed, opening the front end fixing device of the support, and leaving the flexible support and the support pipe in the borehole;

S206, controlling the stop valve, letting the water return to the water tank through the high-pressure water pipe, and removing the drill pipe at this position;

S207, disassembling the withdrawn drill pipe after the drill pipe is withdrawn, connecting the water injection support pipe with the hydraulic pump, and applying the hydraulic pressure to the hole protection support; turning on the tractors, triggering the tractors at the slot, and making the first flexible support bundle around the slot through the movement of the slide rails;

S208, connecting the water injection support pipe to the hydraulic pump, and applying the hydraulic pressure to the hole protection support to unfold the first flexible support for fitting around the slot;

S209, controlling the stop valve to make the water enter the borehole through the high-pressure water pipe and the drill pipe when the drill bit is withdrawn to the next slotting position, and first delivering the water to the borehole for a period of time to remove the residues in the borehole, and then slotting after the return water from the borehole is normal;

S210, immediately stopping the pressure and turning off the water pump after all the slotting is completed, closing the pressure relief valve, dismantling the hydraulic slotting shallow spiral integral drill pipe and piling the dismantled drill pipes neatly, and keeping the high-low pressure conversion slotting device, the diamond compact drill bit and the ultra-high pressure rotary water tail properly;

S211, constructing the fracturing borehole at an appropriate position on the other side of the gas-rich zone;

S212, adjusting the pressure of the drilling rig end, and drilling from the borehole position of the hydraulic slotting borehole to the preset position with the drilling rig; withdrawing the drill pipe and the drill bit, and meanwhile sealing the borehole in the fracturing area with the cement slurry, and leaving the flexible support and the support pipe in the borehole;

S213, adjusting the expansion device of the one-way valve, adjusting the one-way valve according to the fracturing borehole position, and sequentially expanding the flexible support and changing the expansion position of the flexible support;

S214, connecting the high-pressure pipeline adapter to the hydraulic fracturing pump group with the fracturing string to start the hydraulic fracturing pump group, opening the water tank to make the high-pressure water reach the fracturing channel through the high-pressure pipeline, and starting the hydraulic fracturing on the slotting borehole;

S215, immediately stopping the pressure and turning off the water pump after the all the fracturing is completed, connecting pipes for the gas drainage, and recording the gas drainage concentration and the purity in time; and S216, opening the one-way valve from the outlet section after the drainage reaches the standard, and starting to relieve the pressure step by step according to the positions of the fracturing borehole and the slot, and recovering the water injection support pipe and the contracted first flexible support.

What is claimed is:

1. A hole protection system for coal seam slotting and fracturing combined drainage, comprising a hydraulic slotting subsystem, a hydraulic fracturing subsystem and a flexible hole protection system;

wherein the hydraulic slotting subsystem comprises an ultra-high pressure water jet generating module, a drill pipe drilling tool module, an orifice sealer, a gas slag separator and a drilling rig;

the water jet generating system comprises an emulsion pump station and a water tank; the drill pipe drilling tool module comprises a drill pipe, a drill bit and a high-pressure water braid; the whole drill pipe is a hollow circular pipe; the drill bit is provided with a radial nozzle and an axial nozzle for injecting high-pressure water; the radial nozzle is arranged at a front end of the drill bit; the axial nozzle is arranged on a side wall of the drill bit; the drill bit is installed at a head end of the drill pipe; an inner cavity of the drill bit is communicated with an inner cavity of the drill pipe; an input end of the high-pressure water braid is connected with the emulsion pump station through a high-pressure pipeline, and an output end is connected with a tail end of the drill pipe;

the orifice sealer has a tubular body; a front end of the orifice sealer is open and fixed on a hole wall of a borehole orifice, and a rear end is connected with the gas slag separator; the drill pipe extends into a borehole from the rear end of the orifice sealer; the gas slag separator is connected with a gas extraction pipeline;

the hydraulic fracturing system comprises an emulsion pump station, a water tank, a hole sealing device, a fracturing string and a casing; the water tank and the emulsion pump are connected by a high-pressure hose; the high-pressure water enters a water quantity regulating device through a high-pressure water pipe after the high-pressure water is generated; the high-pressure water pipe is provided with a flowmeter and the pressure gauge; a front section of the fracturing string is connected with a high-pressure pipeline adapter;

the flexible hole protection system comprises a front end fixing device, a water injection support pipe and a first flexible support; a pipe wall of the water injection support pipe is provided with a water injection hole; a head end of the water injection support pipe is connected and fixed with the front end fixing device, and a tail end is communicated with a hydraulic pump; the front end fixing device is provided with a supporting hook claw; the supporting hook claw adopts a compression spring structure; the water injection support pipe is arranged in the inner cavity of the drill pipe; the front end fixing device is arranged in a central hole channel of the drill bit; the supporting hook claw of the front end fixing device is clamped with an inner wall of the central hole channel;

the first flexible support is a net sleeve structure; the first flexible support comprises a plurality of annular support pipes arranged in sequence along a longitudinal direction; each annular support pipe comprises several unit waves, and the unit waves are arranged in sequence along a circumferential direction; two adjacent annular support pipes are distributed in mirror symmetry; two opposite wave peaks of the two adjacent annular support pipes are fixedly connected; inner cavities of the two adjacent annular support pipes are communicated; the inner cavities of the plurality of annular support pipes form a pipe net structure; and the first flexible support in a contracted state is sleeved on a pipe body of the water injection support pipe under a non-working condition; and the water injection hole is communicated with a pipe net inner cavity of the first flexible support.

2. The hole protection system for coal seam slotting and fracturing combined drainage according to claim 1, further comprising a second flexible support; wherein the second flexible support comprises a circular pipe I and a circular pipe II, and a plurality of annular support pipes arranged between the circular pipe I and the circular pipe II; each annular support pipe comprises a plurality of unit waves, and the unit waves are arranged in sequence along the circumferential direction; two opposite wave peaks of two adjacent annular support pipes are fixedly connected; an inner cavity of the second flexible support is communicated with a hydraulic pump; fixed tractors drive the circular pipe I and the circular pipe II to approach during working, and the annular support pipes deform and fit the slot; the second flexible support in the contracted state is sleeved on the pipe body of the water injection support pipe under the non-working condition; and the water injection hole is communicated with the inner cavity of the second flexible support.

3. The hole protection system for coal seam slotting and fracturing combined drainage according to claim 2, wherein both the first flexible support and the second flexible support are made of a silicon bronze elastic alloy.

4. An in-situ slotting-fracturing combined permeability enhancement and hole protection method of the system according to claim 2, comprising following steps:

S101, installing and supporting firmly a drilling rig, a pump, a tank and a connecting pipeline after these equipment are transported to a construction site; connecting the pipeline, an emulsion pump, laying a high-pressure pipeline and debugging the high-pressure pipeline; completing an inspection of related systems after a preparation for equipment installation and connection is completed;

S102, constructing a drainage borehole according to an outburst prevention design of a working face and according to a preset slotting borehole position;

S103, sequentially connecting a diamond compact drill bit and a hydraulic slotting shallow spiral drill pipe, and installing a hydraulic slotting spray head with a nozzle at a front end of a high-pressure water jet drill pipe; pushing the drill bit to connect the drill pipe with the drill bit, pushing the drilling rig, starting the drilling rig to make the drill pipe rotate at a low speed, and drilling the borehole by using low-pressure water;

S104, turning on a high-pressure water pump to make water enter the drill pipe through an ultra-high pressure hose after the drill bit is drilled to a designed position; controlling a stop valve, adjusting the pressure at a drilling rig end, and adjusting a pressure valve to gradually increase the pressure of a jet system; and carrying out rotary cutting on a coal body of a borehole wall by using a high-pressure water jet from a high-pressure spray head after the pressure is stable, where a rotary cutting duration for each cutter is 20-25 minutes;

S105, withdrawing with the drill bit and the drill pipe after the slot is formed, opening a front end fixing device of the support, and leaving a flexible support and the support pipe in the borehole;

S106, controlling the stop valve, letting the water return to the water tank through a high-pressure water pipe, and removing the drill pipe at this position;

S107, disassembling the withdrawn drill pipe after the drill pipe is withdrawn, connecting the water injection support pipe with the hydraulic pump, and applying a hydraulic pressure to a hole protection support; turning on the tractors, triggering the tractors at the slot, and making the first flexible support bundle around the slot through a movement of slide rails;

S108, adjusting the pressure of the drilling rig end, and drilling from the borehole position of a hydraulic slotting borehole to a preset position with the drilling rig; withdrawing the drill pipe and the drill bit, and meanwhile sealing the borehole in a fracturing area with cement slurry, and leaving the flexible support and the support pipe in the borehole;

S109, adjusting an expansion device of a one-way valve, adjusting the one-way valve according to a fracturing borehole position, and sequentially expanding the flexible support and changing an expansion position of the flexible support;

S110, connecting the water injection support pipe to the hydraulic pump after the drill pipe is withdrawn, and applying the hydraulic pressure to the hole protection support to unfold the first flexible support in the slot for fitting around the slot;

S111, controlling the stop valve to make the water enter the borehole through the high-pressure water pipe and the drill pipe when the drill bit is withdrawn to a next slotting position, and first delivering the water to the borehole for a period of time to remove residues in the borehole, and then slotting after return water from the borehole is normal;

S112, immediately stopping the pressure and turning off the water pump after all the slotting is completed, closing a pressure relief valve, dismantling a hydraulic slotting shallow spiral integral drill pipe and piling dismantled drill pipes neatly, and keeping a high-low pressure conversion slotting device, the diamond compact drill bit and an ultra-high pressure rotary water tail properly;

S113, connecting a high-pressure pipeline adapter to a hydraulic fracturing pump group with the fracturing string to start the hydraulic fracturing pump group, opening the water tank to make the high-pressure water reach a fracturing channel through the high-pressure pipeline, and starting hydraulic fracturing on the slotting borehole;

S114, immediately stopping the pressure and turning off the water pump after the all the fracturing is completed, connecting pipes for gas drainage, and recording a gas drainage concentration and a purity in time; and S115, opening the one-way valve from an outlet section after the drainage reaches a standard, and starting to relieve the pressure step by step according to positions of the fracturing borehole and the slot, and recovering the water injection support pipe and the contracted first flexible support.

5. A dividing drilling slotting-fracturing combined permeability enhancement and hole protection method of the system according to claim 2, comprising following steps:

S201, installing and supporting firmly a drilling rig, a pump, a tank and a connecting pipeline after these equipment are transported to a construction site; connecting the pipeline, an emulsion pump, laying a high-pressure pipeline and debugging the high-pressure pipeline; completing an inspection of related systems after a preparation for equipment installation and connection is completed;

S202, constructing a drainage borehole according to an outburst prevention design of a working face and according to preset positions of a fracturing borehole and a slotting borehole;

S203, sequentially connecting a diamond compact drill bit and a hydraulic slotting shallow spiral drill pipe, and installing a hydraulic slotting spray head with a nozzle at a front end of the high-pressure water jet drill pipe; pushing the drill bit to connect the drill pipe with the drill bit, pushing the drilling rig, starting the drilling rig to make the drill pipe rotate at a low speed, and drilling the borehole by using low-pressure water;

S204, turning on a high-pressure water pump to make the water enter the drill pipe through an ultra-high pressure hose after the drill bit is drilled to a designed position; controlling a stop valve, adjusting a pressure at a drilling rig end, and adjusting the pressure valve to gradually increase the pressure of a jet system; and carrying out rotary cutting on a coal body of a borehole wall by using a high-pressure water jet from a high-pressure spray head after the pressure is stable, where a rotary cutting duration for each cutter is 20-25 minutes;

S205, withdrawing with the drill bit and the drill pipe after a slot is formed, opening a front end fixing device of the support, and leaving the flexible support and the support pipe in the borehole;

S206, controlling the stop valve, letting the water return to a water tank through the high-pressure water pipe, and removing the drill pipe at this position;

S207, disassembling a withdrawn drill pipe after the drill pipe is withdrawn, connecting the water injection support pipe with a hydraulic pump, and applying a hydraulic pressure to a hole protection support; turning on the tractors, triggering the tractors at the slot, and making a first flexible support bundle around the slot through a movement of slide rails;

S208, connecting the water injection support pipe to the hydraulic pump, and applying a hydraulic pressure to the hole protection support to unfold the first flexible support for fitting around the slot;

S209, controlling a stop valve to make the water enter the borehole through the high-pressure water pipe and the drill pipe when the drill bit is withdrawn to a next slotting position, and first delivering the water to the borehole for a period of time to remove residues in the borehole, and then slotting after return water from the borehole is normal;

S210, immediately stopping the pressure and turning off the water pump after all the slotting is completed, closing a pressure relief valve, dismantling a hydraulic slotting shallow spiral integral drill pipe and piling dismantled drill pipes neatly, and keeping a high-low pressure conversion slotting device, a diamond compact drill bit and an ultra-high pressure rotary water tail properly;

S211, constructing the fracturing borehole at an appropriate position on an other side of a gas-rich zone;

S212, adjusting the pressure of a drilling rig end, and drilling from a borehole position of a hydraulic slotting borehole to the preset position with the drilling rig; withdrawing the drill pipe and the drill bit, and meanwhile sealing the borehole in a fracturing area with cement slurry, and leaving a flexible support and the support pipe in the borehole;

S213, adjusting an expansion device of a one-way valve, adjusting the one-way valve according to the fracturing borehole position, and sequentially expanding the flexible support and changing an expansion position of the flexible support;

S214, connecting a high-pressure pipeline adapter to a hydraulic fracturing pump group with a fracturing string to start the hydraulic fracturing pump group, opening the water tank to make the high-pressure water reach a fracturing channel through the high-pressure pipeline, and starting hydraulic fracturing on the slotting borehole;

S215, immediately stopping the pressure and turning off the water pump after the all the fracturing is completed, connecting pipes for gas drainage, and recording a gas drainage concentration and a purity in time; and S216, opening the one-way valve from an outlet section after the drainage reaches the standard, and starting to relieve the pressure step by step according to the positions of the fracturing borehole and the slot, and recovering the water injection support pipe and the contracted first flexible support.

* * * * *